US005427434A

United States Patent [19]

Hybarger

[11] Patent Number: 5,427,434

[45] Date of Patent: Jun. 27, 1995

[54] CHAIR TILT AND HEIGHT ADJUSTMENT MECHANISM

[75] Inventor: Kenneth C. Hybarger, Belmont, Mich.

[73] Assignee: Leggett & Platt, Incorporated, Carthage, Mo.

[21] Appl. No.: 99,946

[22] Filed: Jul. 30, 1993

[51] Int. Cl.[6] ..... A47C 3/00

[52] U.S. Cl. ..... 297/302; 297/305; 297/344.19

[58] Field of Search ..... 297/285, 291, 300–302, 297/304, 305, 325–328, 344.12, 344.18, 344.19; 248/577

[56] References Cited

U.S. PATENT DOCUMENTS

| | | | |
|---|---|---|---|
| 3,656,805 | 4/1972 | Engstrom | 297/302 |
| 4,375,301 | 3/1983 | Pergler et al. . | |
| 4,438,898 | 3/1984 | Knoblauch et al. . | |
| 4,494,795 | 1/1985 | Roossien et al. . | |
| 4,555,085 | 11/1985 | Bauer et al. | 297/304 X |
| 4,598,892 | 7/1986 | Franckowiak et al. . | |
| 4,695,093 | 9/1987 | Suhr et al. . | |
| 4,743,065 | 5/1988 | Meiller et al. . | |
| 4,818,019 | 4/1989 | Mrotz, III . | |
| 4,832,402 | 5/1989 | Zünd . | |
| 4,852,943 | 8/1989 | Roper | 297/325 X |
| 4,938,531 | 7/1990 | Fogarassy . | |
| 4,948,198 | 8/1990 | Crossman et al. . | |
| 5,018,787 | 5/1991 | Estkowski et al. . | |
| 5,106,157 | 4/1992 | Nagelkirk et al. . | |
| 5,160,184 | 11/1992 | Faiks et al. . | |
| 5,207,479 | 5/1993 | Wickman et al. . | |
| 5,280,998 | 1/1994 | Miotto et al. | 297/302 |

FOREIGN PATENT DOCUMENTS

| | | |
|---|---|---|
| 2061615 | 9/1992 | Canada . |
| 2257033 | 1/1993 | United Kingdom . |

*Primary Examiner*—Kenneth J. Dorner
*Assistant Examiner*—Milton Nelson, Jr.
*Attorney, Agent, or Firm*—Varnum, Riddering, Schmidt & Howlett

[57] ABSTRACT

A chair tilt mechanism incorporating a tilt stop and height adjustment mechanism on a single lever is disclosed. In addition, the component parts of the chair tilt mechanism can be formed by conventional stamping operations which allows for the standard components to be used for a wide variety of chair tilt applications. The chair tilt mechanism includes a housing mounted to the support spindle and rails mounted to the underside of a chair. The rails are pivotally mounted to the housing and a load bracket member is fixedly mounted to the rails. A tilt adjustment spring extends between the load bracket and the housing. A lever is received within the housing and is laterally movable within the housing to selectively engage a tilt lock and adjust the height of the chair.

29 Claims, 8 Drawing Sheets

CHAIR TILT AND HEIGHT ADJUSTMENT MECHANISM

BACKGROUND OF THE INVENTION

1. Field of the Invention

This invention relates to a chair tilt and height adjustment mechanism and, more particularly, to a knee-tilt mechanism having a single lever to lock the tilt mechanism and to release a height adjusting gas cylinder.

2. Description of Related Art

Chairs having mechanisms permitting tilting of the chair backs are disclosed in U.S. Pat. Nos. to Crossman et al. 4,948,198 issued Aug. 14, 1990, Nagelkirk et al. 5,106,157 issued Apr. 21, 1992; Meiller et al. 4,743,065 issued May 10, 1988; Zünd 4,832,402 issued May 23, 1989; Pergler et al. 4,375,301 issued Mar 1, 1983; and Mrotz, III 4,818,019 issued Apr. 4, 1989. Several of these chairs disclose control means to lock the chair in the upright position as well as adjust the height of the chair through cooperation with a gas cylinder. Typically, two or more levers or other control devices are used to accomplish the tasks of locking the chair in the upright position and adjusting the height of the chair. The use of two or more control mechanisms complicates the use of the chair, increases the manufacturing cost of the chair tilt mechanism, and denigrates the appearance of the chair.

Another problem with chair tilt mechanisms and particularly knee tilt mechanisms is the cost in manufacturing the load bearing member of the tilt mechanism. Chair tilt load bearing members are traditionally formed by a metal casting operation which makes these parts relatively expensive relative to metal stamping. Although metal stampings have been used in chair tilt mechanisms, they tend to be complicated, requiring many parts and not necessarily of low profile. It is desirable to maintain a low, compact profile for the chair tilt mechanisms to enhance the appearance of the chair.

SUMMARY OF INVENTION

According to the invention, a chair tilt and height adjustment mechanism has a single control lever to lock the chair into the upright position and to adjust the height of the chair. In addition, the main parts of the chair tilt mechanism can be made with relatively inexpensive metal stampings. Further, the resulting tilt mechanism has a compact, low profile.

According to the invention, the chair tilt mechanism comprises a housing adapted to be attached to a chair spindle, a pair of rails adapted to be attached to a chair seat, a pivot pin pivotably mounting the rails to the housing for pivotal rotation of the rails with respect to the housing between an upright position and a reclining position and a spring connected to the rails at one end and to the housing at the other end to bias the rails toward the upright position. A load bracket has a central plate, a pair of side walls depending from the central plate and a pair of apertures in the side walls adapted to snugly receive the pivot pin. A fastener is spaced from the pivot pin to join the side walls of the load bracket to the rails such that the load bracket is rigidly joined to the rails. The relative position of the rails with respect to the housing is determined by the relative fastened position of the load bracket side walls with respect to the rails. The spring abuts the central plate of the load bracket so that the spring is compressed as the rails pivot from the upright position to the reclining position.

In one embodiment of the invention, a pair of side walls extend upwardly from the housing and a bolt bar extends across the side walls at an upper portion thereof. A bolt is mounted to the bolt bar and has a threaded lower end. The spring is mounted to the bolt. An adjustment cap is threaded onto the bolt at a lower end thereof and receives the other end of the spring. The tension of the spring is adjusted by rotation of the adjustment cap with respect to the bolt.

Preferably, the load bracket is a metal stamping. Preferably, the housing and bolt bar are also metal stampings.

The invention also contemplates a lever which is pivotably mounted to the housing for controlling the height of the chair seat by actuation of a gas cylinder mounted to the housing through a telescoping spindle. A gas cylinder pawl is nonrotatably mounted to the lever for depressing the gas cylinder actuator upon rotational movement of the lever with respect to the housing. A tilt lock mechanism is mounted to the lever for selective locking of the load bracket with respect to the housing to selectively lock the rail in the upright position. Preferably, the tilt lock mechanism comprises a tilt lock pawl which is mounted to the lever for limited rotation with respect thereto so that the lever is rotatable through a small angle to depress the gas cylinder regardless of whether the tilt lock mechanism is in the locked or unlocked position.

In still another embodiment, the lever is laterally movable with respect to the load bracket to shift the locking mechanism between the locked and unlocked positions. Preferably, an overcenter spring is mounted to the lever and engages the housing to bias the lever into both the locked and unlocked positions.

The pivot pin is preferably mounted at a forward position of the housing so that a chair mounted to the rails tends to tilt about the knee of the user.

The invention further contemplates a baffle which is mounted to a rear portion of the rails to shield the housing from view and to prevent possible intrusion of objects between the housing and the chair seat during the tilting movement of the rails with respect to the housing.

BRIEF DESCRIPTION OF THE DRAWINGS

The invention will now be described with reference to the drawings in which.

DESCRIPTION OF THE PREFERRED EMBODIMENTS

Figure 1:
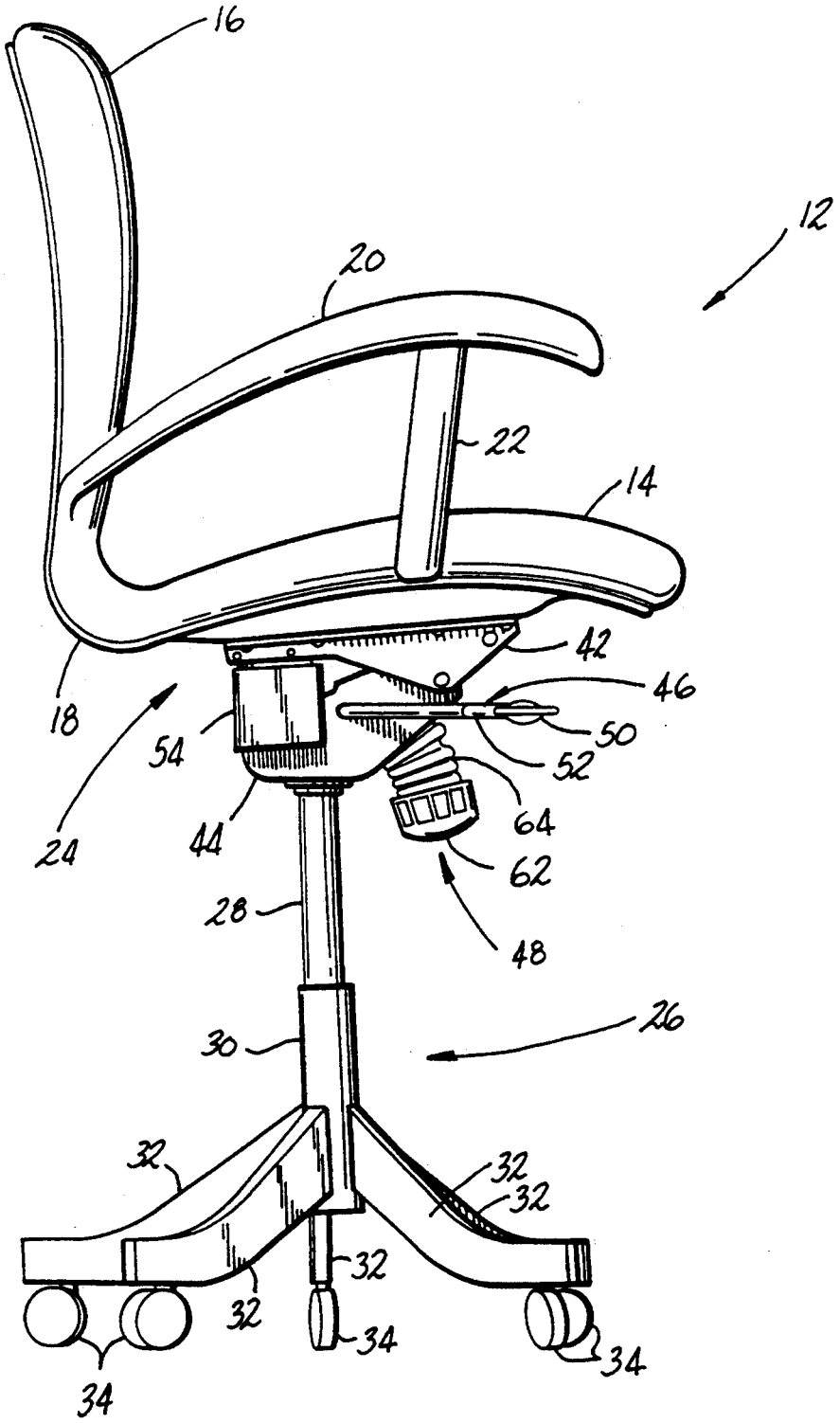
FIG. 1 is a right side elevational view of a chair having a chair tilt and height adjustment mechanism according to the invention.

Referring now to the drawings and to FIG. 1 in particular, a chair 12 comprising a seat 14 interconnected to a backrest 16 by a web 18. An armrest 20 extends forward from the backrest 16 and is supported from the seat 14 by an armrest support 22. The seat 14 is supported by a chair tilt and height adjustment mechanism 24 and a spindle 26. The spindle 26 comprises a first support member 28 which is telescopically received within a second support member 30. A conventional gas cylinder 36 (FIG. 6) is mounted within the first and second support members 28, 30 for adjusting the vertical position of the chair in conventional fashion. A plurality of legs 32 extend radially outwardly from the lower end of the second support member 30. Preferably, casters 34 are mounted at the outer end of the radial legs 32 to permit rolling action of the chair 12.

The chair tilt and height adjustment mechanism 24 comprises a pair of opposed rails 42 mounted to the underside of the seat 14, a housing 44 to which the rails 42 are pivotally mounted, a lever 46 to control the adjustments of the chair tilt and height adjustment mechanism 24 and a spring assembly 48 to bias the chair into the upright position as seen in FIG. 1. The lever 46 comprises a handle 50 and a shaft 52 which extends from the handle 50 into the housing 44. A baffle 54 is mounted to the rear of the rails 42 to shroud the housing and to prevent the intrusion of objects between the chair seat 14 and the housing 44 as the chair pivots relative to the housing 44.

The spring assembly 48 comprises a conventional coil spring 60 (FIG. 6) which extends downwardly from the housing 44 and is received in a tension adjustment cap 62. The spring 60 is preferably enclosed within bellows 64 to prevent the user from pinching his or her fingers between coils of the spring as the chair 12 reclines from the upright to the recline position and to shroud the spring 60.

Figure 2:
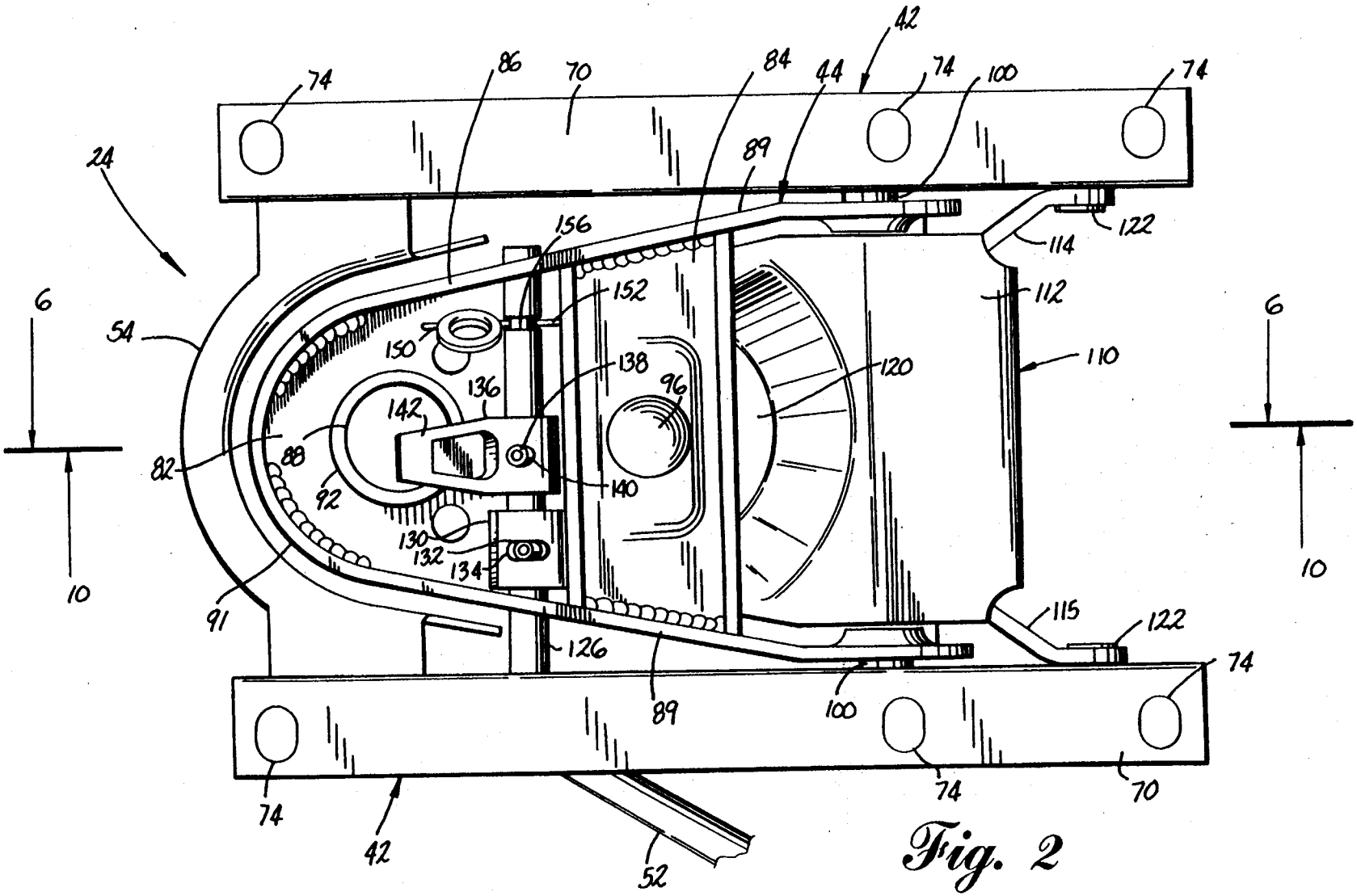
FIG. 2 is a top plan view of the chair tilt and height adjustment mechanism according to the invention.
Figure 3:
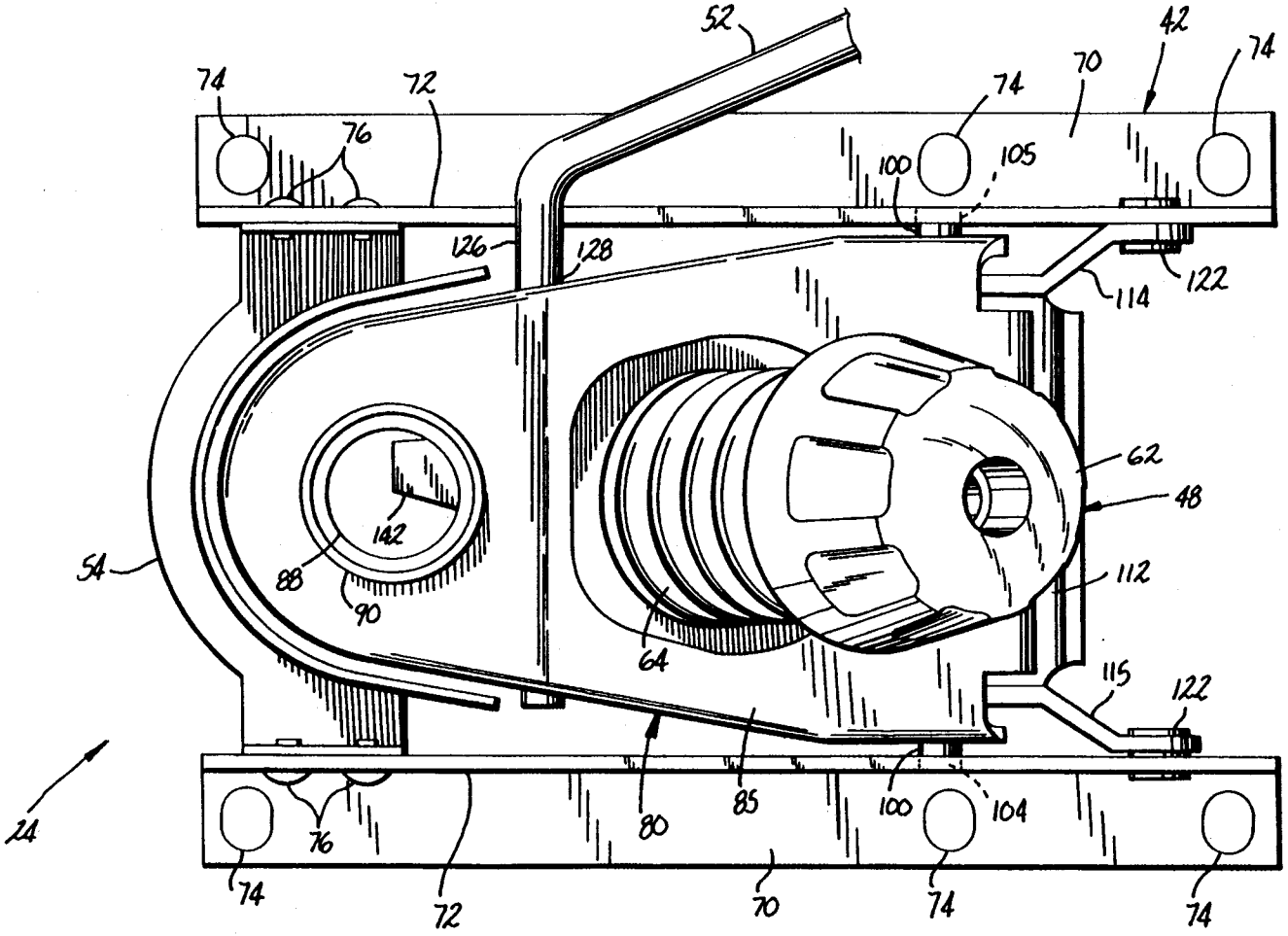
FIG. 3 is a bottom plan view of the chair tilt and height adjustment mechanism according to the invention.

As seen in FIGS. 2 and 3, the rails 42 of the chair tilt mechanism 24 are parallel to and spaced from one another. The rails 42 are L-shaped in cross section and comprise a horizontal leg 70 and a vertical leg 72. Alternatively, the rails can be U-shaped in cross section. The horizontal legs 70 have formed therein a plurality of mounting apertures 74 which are adapted to receive screws or other fastening means for mounting the chair tilt mechanism 24 to the underside of the seat 14. The baffle 54 is secured to the opposing vertical legs 72 of the rails 42 by suitable fasteners, such as projections 76 which snap fit into holes in the rail vertical legs 72.

Figure 6:
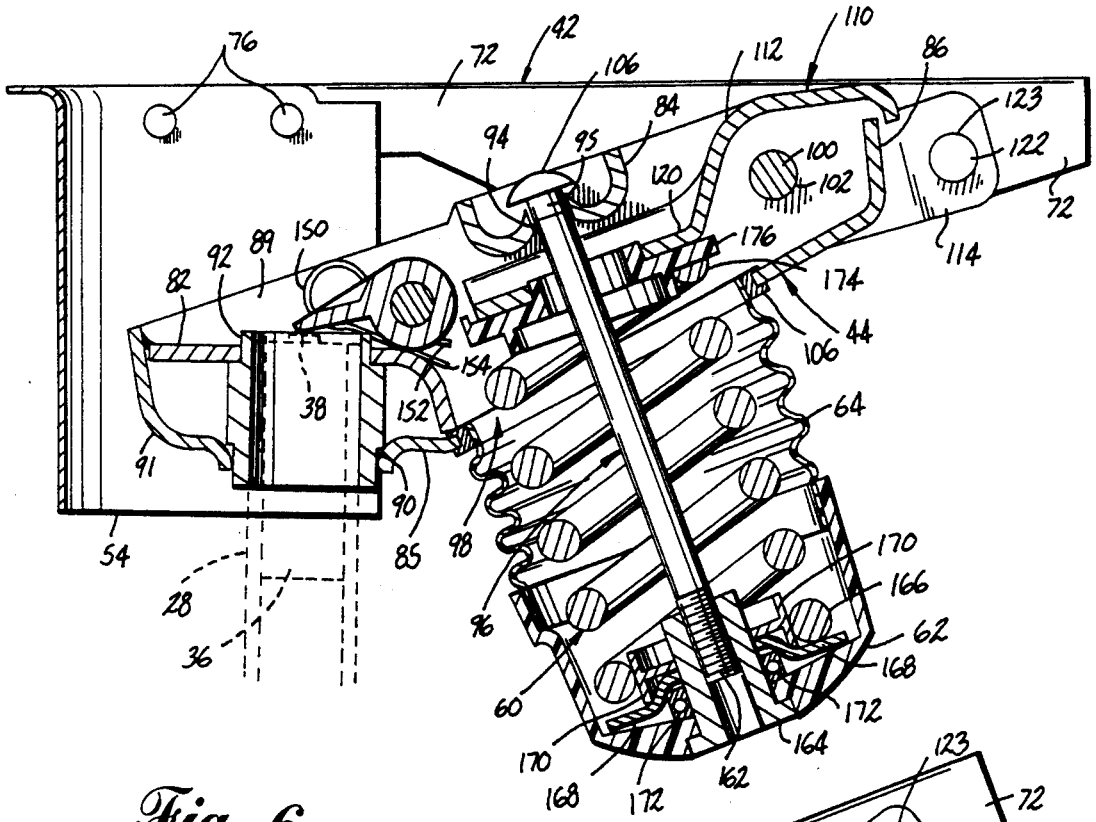
FIG. 6 is a sectional view of the chair tilt and height adjustment mechanism taken along lines 6—6 of FIG. 2, showing the chair tilt and height adjustment mechanism in the upright position.

The housing 44 comprises a bottom wall 85 having an upstanding front wall 86, opposed upstanding side walls 89 and an upstanding rear wall 91. A first aperture 90 is formed in the bottom wall 85 which is adapted to receive the first support member 28 of the spindle 26. A second aperture 98 is formed in the bottom wall 85 and is adapted to receive the biasing spring 60 (FIG. 6). A plastic ring 106 having a U-shaped cross-sectional configuration extends around the rim of the second aperture 98. The gusset plate 82 is mounted to the rear wall 91 of the housing 44 by suitable means such as welding. A tapered bushing 88 is received in the first aperture of the housing bottom wall 85 and an aperture 92 of the gusset plate. The upper end of the first support member 28 is received in the tapered bushing 88.

A bolt bar 84 is mounted to the side walls 89 of the housing 44 intermediate the front and rear walls 86, 91 of the housing 44 by suitable means such as welding. The bolt bar 84 is preferably made of a sheet metal stamping. As seen in FIG. 6, the bolt bar 84 is W-shaped in cross section and has a square aperture 94 formed therein to receive the square neck 95 of the support bolt 96 of the biasing means 48. The cooperation of the square aperture 94 and the square neck 95 of the bolt prevent rotation of the bolt relative to the housing 44. A pivot pin 100 extends through apertures 102, 103 of the side walls 89 of the housing 44 and through apertures 104, 105 of the rails 42 to pivotally mount the housing 44 to the rails 42.

A load bracket member 110 is received within the housing 44 of the chair tilt and height adjustment mechanism 24. The load bracket member 110 comprises a load bracket plate 112 having a pair of forwardly and outwardly extending support arms 114, 115, a pair of downwardly extending side walls 116, 118 (FIG. 11) and a biasing surface 120 adapted to engage the spring 60 of the biasing means 48. The support arms 114, 115 of the load bracket member 110 are secured to the opposing vertical legs 72 of the rail 42 by suitable fastening means such as rivets 122 which pass through suitable apertures 123, 124 of the support arms 114, 115.

The distal end 126 of the lever shaft 52 extends through an aperture 128 of the housing side wall 89 and into the housing 44. A locking pawl 130 is concentrically mounted on the distal end 126 of the shaft 52 such that the shaft 52 can rotate within the pawl 130. A mounting pin 132 extends upwardly from the distal end of the shaft 126 and is received in an elongated slot 134 formed in the locking pawl.

A gas cylinder pawl 136 is also concentrically mounted on the distal end of the shaft 126 by a mounting pin 138. However, the gas cylinder pawl is securely mounted to the shaft 52 such that the pawl 136 rotates with the shaft 52. The mounting pin 138 is received in a mounting pin aperture 140 of the gas cylinder pawl 136. The gas cylinder pawl 136 includes an outwardly extending tab 142 which is adapted to selectively depress an actuator button 38 on the top of the gas cylinder 36 to adjust the height of the chair.

Figure 8:
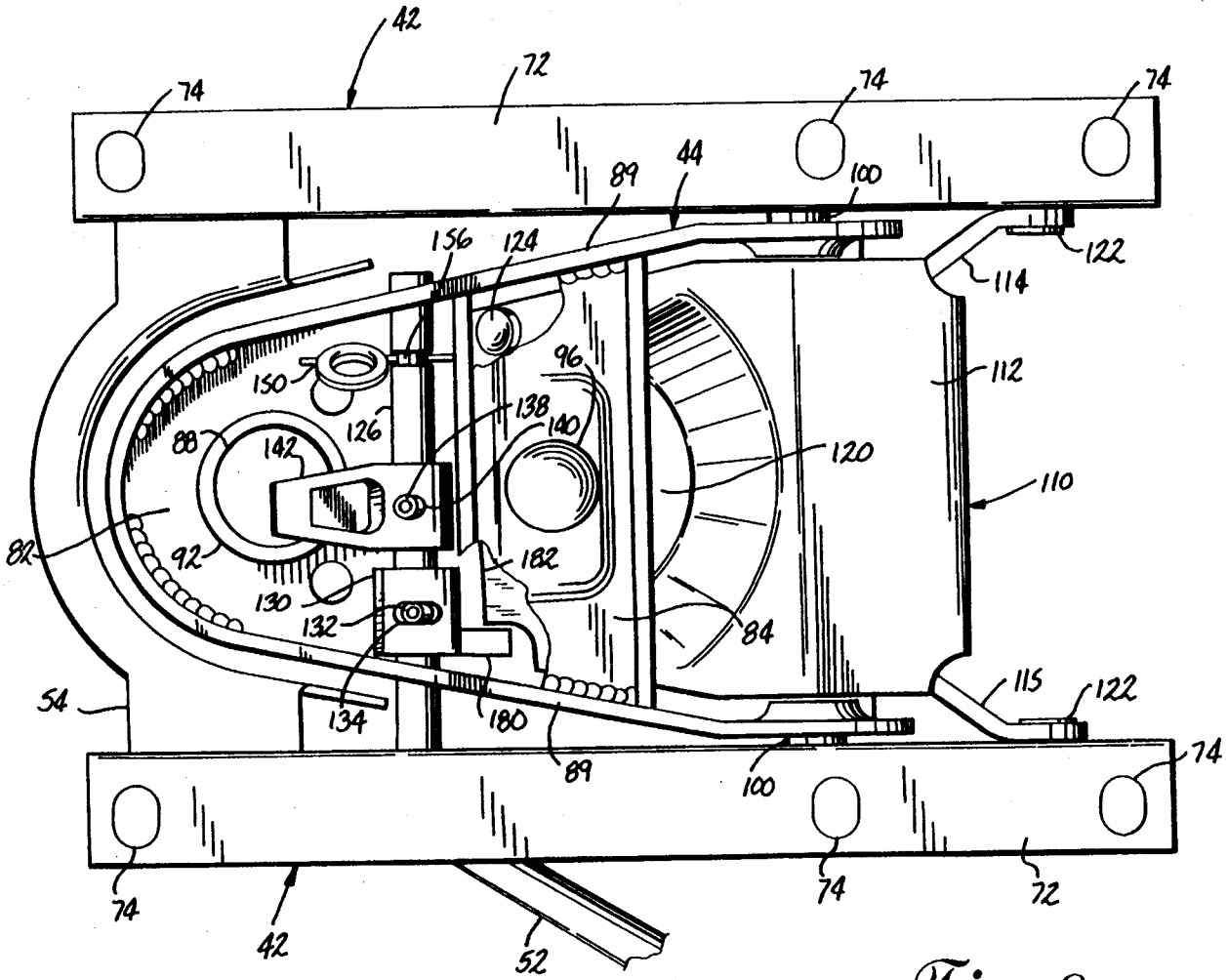
FIG. 8 is a top plan view of the chair tilt and height adjustment mechanism showing the chair tilt stop in the unlocked position.
Figure 9:
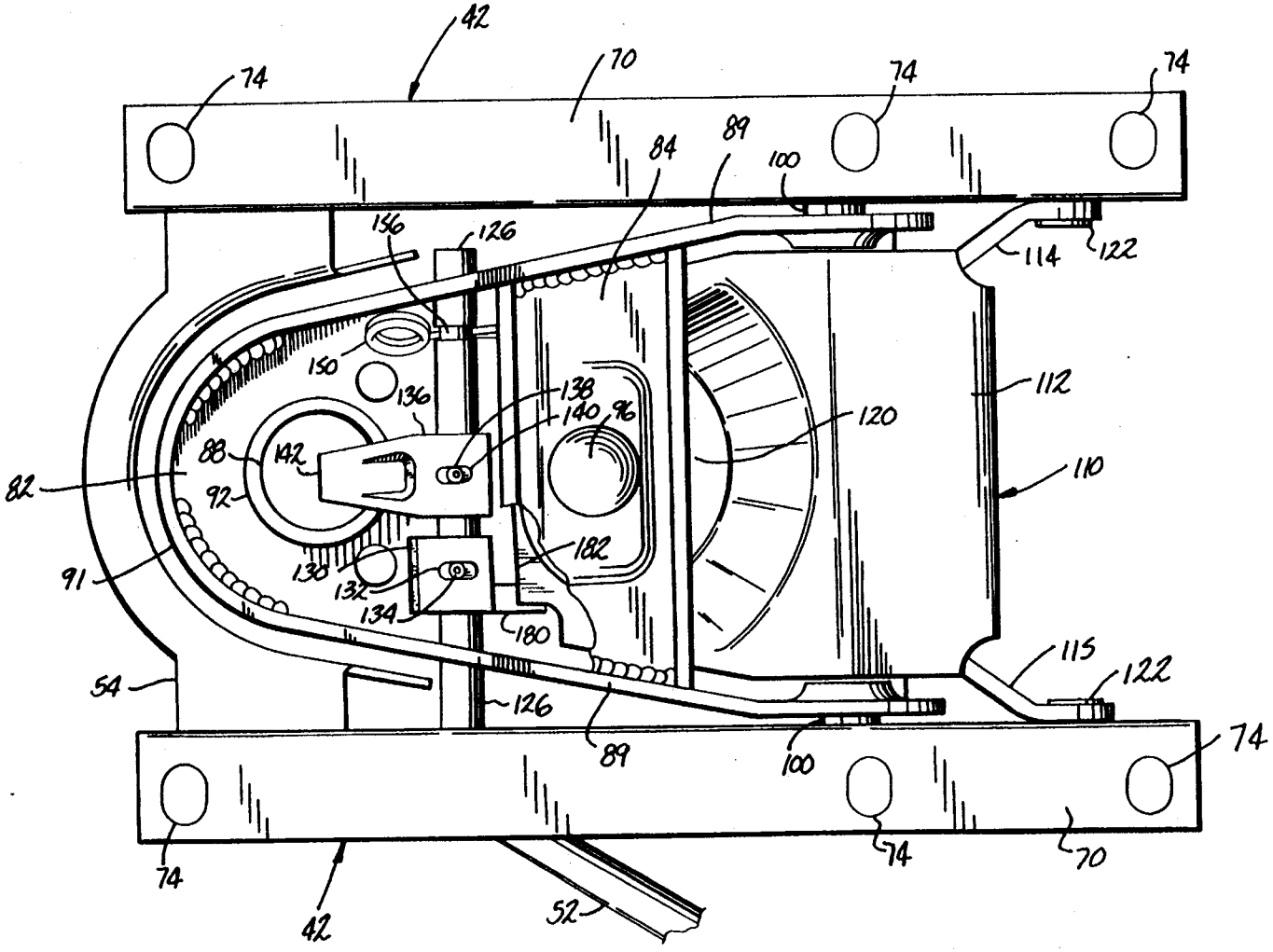
FIG 9 is a top plan view of the chair tilt and height adjustment mechanism showing the chair tilt stop in the locked position.

A lever biasing spring 150 is mounted between the distal end 126 of the lever shaft 52 and the gusset plate 82. The lever biasing spring 150 is a conventional torsion spring having a first and second arm 152, 154, respectively. Alternatively, a leaf spring can be used in lieu of the torsion spring. The first arm engages a groove 156 formed in the distal end 126 of the shaft 52 and the second arm 154 is mounted to the gusset plate 82. The spring 150 is mounted such that it pivots from a first overcenter position as seen in FIG. 8 to a second overcenter position as seen in FIG. 9 to bias the lever in one of the two lateral positions.

Figure 4:
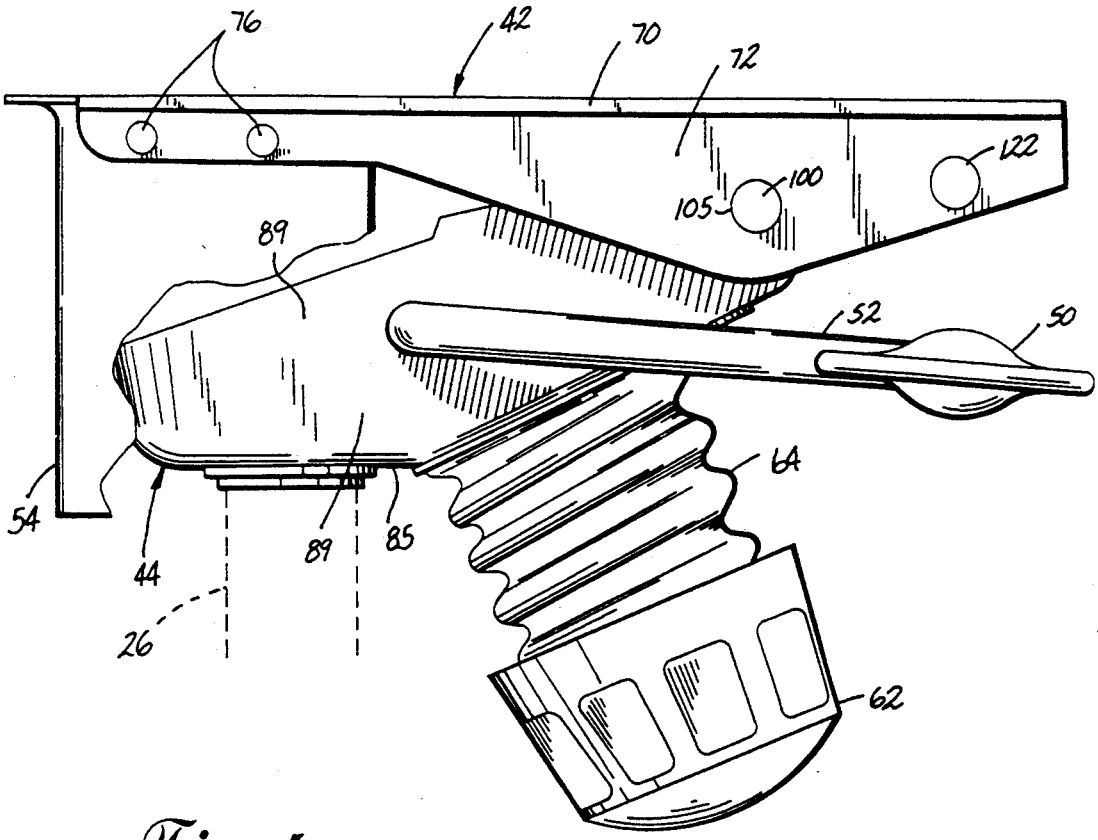
FIG 4 is a right side elevational view of the chair tilt and height adjustment mechanism in the upright position.
Figure 5:
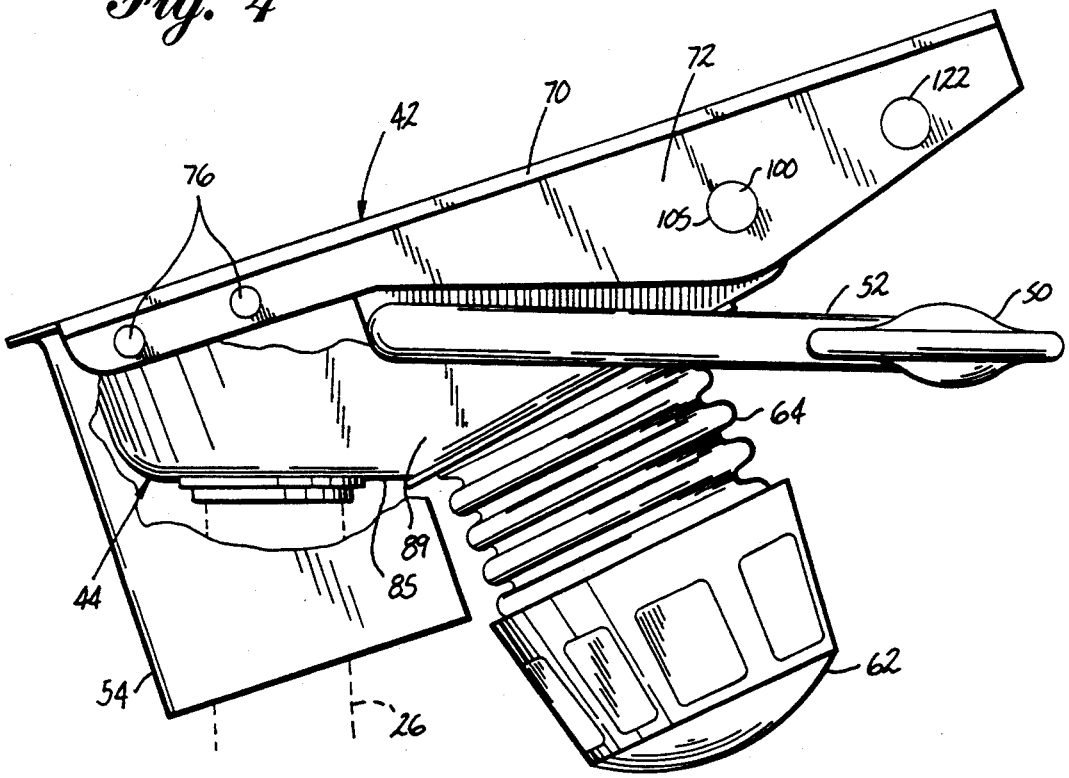
FIG. 5 is a right side elevational view of the chair tilt and height adjustment mechanism in the reclined position.

FIGS. 4 and 5 are right side elevational views of the chair tilt and height adjustment mechanism. FIG. 4 depicts the mechanism in the upright position and FIG. 5 depicts the mechanism in the fully reclined position. In the upright position, the rails 42 are substantially horizontal and the housing 44 extends upwardly from the spindle 26 to the pivot pin 100. As the user reclines the chair, the housing 44 remains stationary and the rails 42 rotate about the central axis of the pivot pin 100 to the fully reclined position, as seen in FIG. 5. In the reclined position, the spring 60 is under compression, thereby urging the chair back to the fully upright position depicted in FIG. 4.

Figure 7:
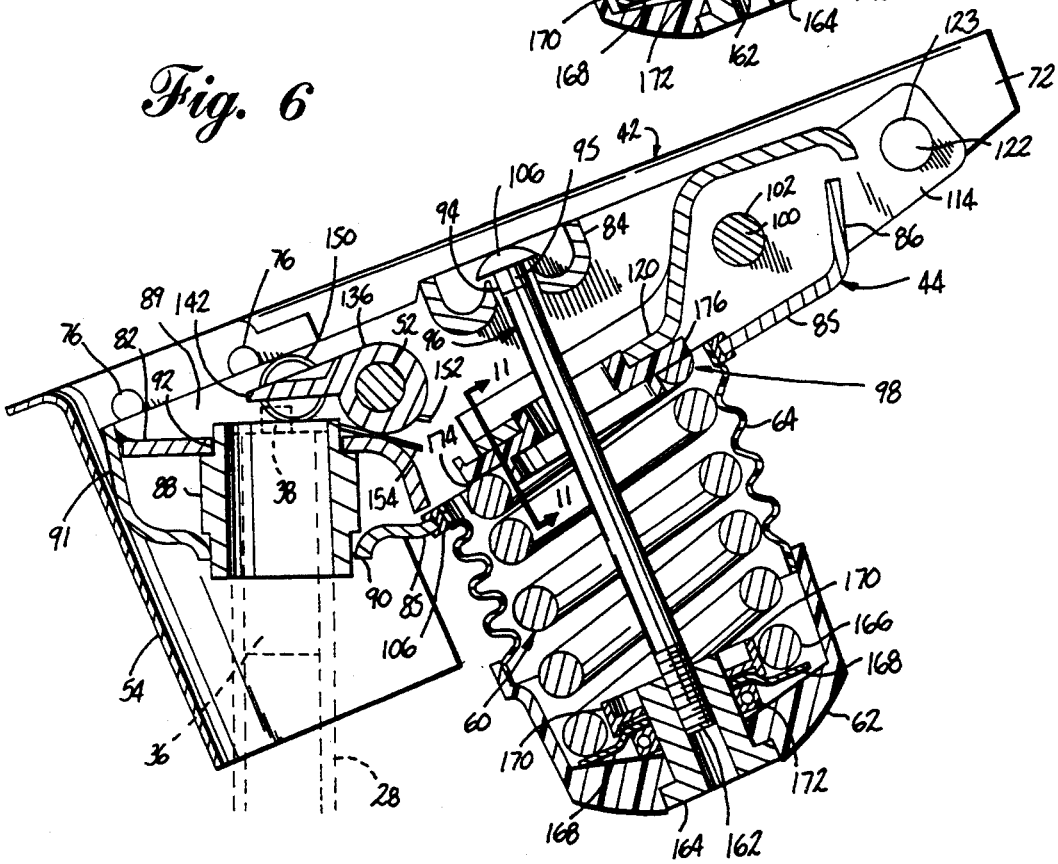
FIG 7 is a sectional view of the chair tilt and height adjustment mechanism similar to the view seen in FIG. 6, showing the chair in the reclined position.

FIGS. 6 and 7 are sectional views of the chair tilt and height adjustment mechanism according to the invention in the upright and fully reclined position as shown in FIGS. 4 and 5 respectively.

As seen in FIG. 6, the head 160 and square neck 95 of the biasing means bolt 96 are non-rotatably retained in the bolt bar 84. The shaft of the bolt 96 extends downwardly through the body of the spring 60 and terminates in a threaded portion 162. The threaded portion 162 is threaded into a threaded bore in a threaded adjustment nut 164 which is securely mounted in the tension adjustment cap 62. A first end 166 of the spring 60 mounts a spring washer 168 and a spring seat 170. A thrust bearing 172 is mounted between the spring washer 168 and the adjustment nut 164 to facilitate the rotation of the adjustment nut 164 and tension adjustment cap relative to the spring 60 and spring washer 168. A second end 174 of the spring 60 is received on a second spring seat 176 mounted to the underside of the biasing surface 120 of the load bracket member 110.

The user adjusts the tension encountered in reclining the chair by rotating the tension adjustment cap 62 and adjustment nut 164 relative to the support bolt 96.

Figure 11:
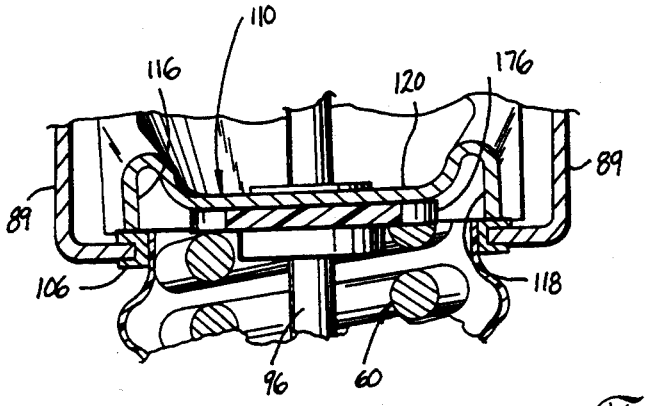
FIG. 11 is a partial sectional view taken along lines 11—11 of FIG. 7.

As seen in FIGS. 6 and 7, the tilting or reclining of the chair from the upright position as seen in FIG. 6 to the reclined position as seen in FIG. 7 is resisted by the compression force of the spring 60. The first end 166 of the spring 60 bears against the adjustment cap 62 which is securely mounted to the housing through the support bolt 96 and the bolt bar 84. The second end 174 of the spring 60 bears against the underside of the load bracket plate 112. As the chair reclines, the load bracket plate 112 pivots about the pivot pin 100 relative to the housing 44 and the spring 60 is compressed. As the tilting force exerted on the spring 60 is relaxed, the spring 60 will return the load bracket member 110 and the rails 42 to the fully upright position as seen in FIG. 6. The maximum tilt angle is limited by the abutment of the bottom edges of the side walls 116, 118 of the load bracket 110 and the bottom wall 85 of the housing 44. As seen in FIG. 11, the bottom edges of the side walls 116, 118 strike the plastic ring at full tilt. The plastic ring 106 provides noise reduction when the bottom edges of the side walls 116, 118 strike the housing 44. The placement of the pivot pin 100 closely adjacent to the spring 60 in a mid pivot position results in the tilting of the chair about a mid pivot axis, i.e., between the front of the rails 42 and the spindle 26.

FIGS. 8 and 9 depict the tilt lock mechanism of the dual function chair tilt and height adjusting mechanism according to the invention. The tilt lock mechanism comprises the locking pawl 130, the lever 46 and the load bracket plate 112. As seen in FIG. 8, a portion of the bolt bar 84 is broken away to reveal a forwardly extending stop tab 180 of the locking pawl 130. Stop tab 180 extends beyond the rear edge 182 of the load bracket plate 112. As seen in FIG. 8, the stop tab 180 is positioned adjacent and below the rear edge 182 of the load bracket plate 112 when the chair is in the upright position. The stop tab 180 in the unlocked position as seen in FIG. 8 does not interfere with the movement of the load bracket plate 112 relative to the housing 44 during tilting of the chair. If the user desires to lock the chair in the upright position and prevent tiling movement, the user applies a lateral force to the shaft 52 toward the housing 44 which moves the distal end 126 of the shaft 52 laterally into the housing 44 a short distance. The distal end of the shaft 126, locking pawl 130 and gas cylinder pawl 136 are moved a short distance laterally within the housing 44 as seen in FIG. 9. As a result of this lateral movement, the stop tab 180 of the locking pawl 30 is positioned immediately below the rear edge 182 of the load bracket plate 112. If the user now tries to tilt the chair, the downward movement of the load bracket plate 112 relative to-the housing 44 is prevented due to the interference of the stop tab 180 with the movement of the rear edge of the load bracket plate 112.

The user can easily unlock the tilt mechanism by exerting a lateral force on the shaft 52 away from the housing 44 which will result in the sliding movement of the distal end of the shaft 126, the locking pawl 130 and the gas cylinder pawl 136 within the housing 44 from the locked position of FIG. 9 to the unlocked position as seen in FIG. 8.

The lever biasing spring 150 resists the lateral movement of the distal end of the shaft 126 within the housing 44 between the locked and unlocked positions. As noted above, the first arm 152 of the spring 150 is received in a groove 156 formed in the distal end 126 of the spring and the second arm 154 of the spring 150 is mounted to the gusset plate 82. In the unlocked position as depicted in FIG. 8, the spring 150 is rotated to an overcenter position. As the distal end 126 of the lever 46 is moved laterally within the housing 44, the spring is compressed further as the spring 156 is brought from its overcenter position to its center position when the spring is under maximum compression. As the distal end 126 of the lever 46 continues to move laterally within the housing 44, the spring 150 biases the distal end 126 of the lever 46 into the locked position as depicted in FIG. 9. The spring 150 moves from its center position under maximum compression to an overcenter position in which it is under less tension. In returning to the unlocked position as depicted in FIG. 8, the spring 150 resists the lateral movement of the distal end 126 of the lever as the spring is moved from its overcenter position to its center position of maximum compression. As the distal end 126 the lever 46 continues to move laterally within the housing 44, the spring 150 biases the lever 46 into the unlocked position as seen in FIG. 8.

As noted above, the locking pawl 130 and gas cylinder pawl 136 are mounted to the distal end 126 of the lever 46 by mounting pins 132 and 138. Therefore, as the distal end 126 of the lever 46 moves laterally within the housing 44, the locking pawl 130 and gas cylinder pawl 136 are similarly moved laterally within the housing 44.

A second portion of the bolt bar 84 is broken away in FIG. 8 to reveal a stop bumper 124 mounted in an aperture of the load bracket plate 112. The stop bumper 124 extends above the top surface of the load bracket plate 112 and below the bottom surface of the load bracket plate 112. The stop bumper 124 is preferably formed of an elastomeric material which prevents the load bracket plate 112 from striking the bottom surface of the bolt bar 84 when the chair is in the upright position.

Figure 10:
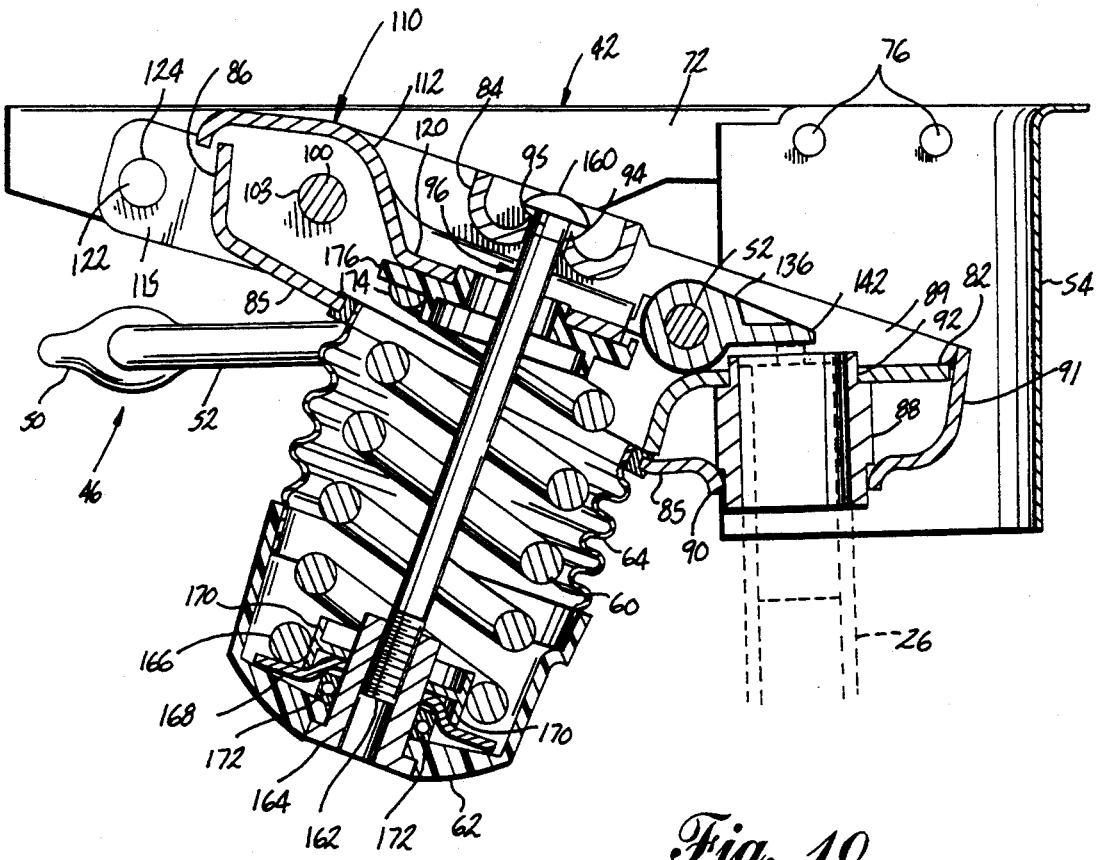
FIG. 10 is a sectional view of the chair tilt and height adjustment mechanism taken along lines 10—10 of FIG. 2.

The dual function lever 46 also controls the height adjustment of the chair as a result of the engagement of the tab 142 of the gas cylinder pawl 136 with the actuator button 38 on the top of the gas cylinder 36. As seen in FIGS. 6 and 10, the tab 142 of the gas cylinder pawl 136 contacts and depresses the top of the gas cylinder 36 when the lever 46 is rotated. As the user lifts the handle 50 of the lever 46 from the nonactuated position as seen in FIG. 10 to the actuated position in FIG. 6, the lever shaft 52 is rotated clockwise as seen in FIG. 10. The gas cylinder pawl 136 is securely mounted to the lever shaft 52 by the mounting pin 138 and therefore rotates as the lever is lifted. The tab 142 depresses the actuator button 38 of the gas cylinder 36 to, as seen in FIG. 6, adjust the height of the chair.

The height of the chair can be adjusted regardless of whether the tilt lock mechanism is locked as depicted in FIG. 9 or unlocked as depicted in FIG. 8 as a result of the unique mounting of the locking pawl 130 to the distal end 126 of the shaft 52. As seen in FIG. 2, the locking pawl 130 is telescopically received on the distal end of the shaft 126 and secured thereto by a mounting pin 132. The pin 132 is received in an elongated slot 134 of the locking pawl 130. As the user lifts the lever 46 to deflect the gas cylinder pawl 136 and adjust the height of the chair, the distal end 126 of the shaft 52 and mounting pin 132 rotate within the locking pawl 130 and elongated slot 134, respectively. The slot 134 and mounting pin 132 are configured such that the lever 46 can be freely rotated to adjust the height without interference by the locking pawl 130.

The chair tilt mechanism according to the invention provides several significant improvements over the chair tilt mechanisms of the prior art. First, the chair tilt mechanism according to the invention can be produced from components which are formed by conventional metal stamping and welding operations. The housing 44, gusset plate 82, bolt bar 84 and load bracket plate 112 are all formed by conventional metal stamping operations. These various components are welded together to create the basic structure of the chair tilt mechanism. The production of these parts, and more importantly the load bracket, from metal stampings provides significant advantages and cost savings over conventional casting operations which are currently used for forming the equivalent of the load bracket in other chair tilt mechanisms.

Another significant improvement of the chair tilt mechanism according to the invention over the prior art is the adaptability of the chair tilt mechanism for chairs of different size and tilt capacity as a result of the rivet connection of the load bracket member 110 to the rails 42. By merely altering the mounting position of the load bracket to the rails, standard components can be utilized for a wide variety of applications, thereby dramatically reducing tooling and production costs.

The maximum angle of tilt can be selected by simply trimming the lower edges of the side walls 116, 118 of the load bracket 110. As seen in FIG. 11, the lower edges of the side walls 116, 118 abut the plastic ring 106 at full tilt. Shortening the sidewalls 116, 118 will increase the angle of tilt. Thus, the invention provides a universal bracket which can be used with several different chair tilt mechanisms.

Still another improvement of the chair tilt mechanism over the prior art is the incorporation of the height adjustment mechanism and the chair tilt stop on a single lever. Through the manipulation of a single lever 46 of the chair tilt mechanism according to the invention, the user can easily adjust the height of the chair and also lock the chair in the fully upright position. Previously, these two functions were accomplished by two independent levers extending outwardly from the chair tilt mechanism. The elimination of one of the levers results in cost savings and makes the chair tilt mechanism easier to operate.

All of these features are incorporated into a low-profile, compact chair tilt and height adjustment mechanism which has substantial advantages over those chair tilt and height adjustment mechanisms heretofore available.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A chair tilt mechanism comprising a housing adapted to be attached to a chair spindle, a pair of rails adapted to be attached to a chair seat, a pivot pin pivotably mounting the rails to the housing for pivotable rotation of the rails with respect to the housing between an upright position and a reclined position, and a spring connected at one end to the housing and at the other end to the rail to bias the rails toward the upright position, the improvement comprising:

a load bracket having a central plate, a pair of side walls depending from the central plate and a pair of apertures in the side walls adapted to snugly receive the pivot pin wherein the spring abuts the central plate so that the spring is compressed as the rails pivot from the upright position to the reclined position; and a pair of fasteners spaced forwardly from the pivot pin to join the side walls to the rails whereby the load bracket is rigidly joined to the rails and the relative position of the rails with respect to the housing is determined by the relative fastened position of the load bracket side walls with respect to the rails.

2. A chair tilt mechanism according to claim 1 wherein the load bracket has a bumper mounted to a rear portion thereof, the bumper being adapted to abut a portion of the housing when the rails are in the upright position.

3. A chair tilt mechanism according to claim 1 wherein the fasteners are rivets.

4. A locking mechanism according to claim 1 wherein the pivot pin is mounted at a forward position of the housing so that a chair mounted to the rails tends to tilt about the knee of a user.

5. A chair tilt mechanism according to claim 1 and further comprising a baffle mounted to a rear portion of the rails to shield the housing during tilting of the rails with respect to the housing.

6. A chair tilt mechanism according to claim 1 wherein the side walls of the load bracket are adapted to strike a portion of the housing to provide a stop when the rails are in the reclined position.

7. A chair tilt mechanism according to claim 1 further comprising:

a pair of housing side walls extending upwardly from the housing and a bolt bar which extends between the side walls at an upper portion of the side walls;

a bolt mounted to the bolt bar and having a threaded lower end; and an adjustment cap threaded onto the bolt at a lower end thereof and receiving the one end of the spring;

whereby the tension of the spring is adjusted by rotation of the adjustment cap with respect to the bolt.

8. A chair tilt mechanism according to claim 7 and further comprising flexible bellows enclosing the spring and extending between the adjustment cap and the housing.

9. A chair tilt mechanism according to claim 1 wherein the load bracket further comprises a pair of support arms extending forwardly of the side walls and the fasteners are secured to the support arms.

10. A chair tilt mechanism according to claim 9 wherein the support arms have apertures formed therein adapted to receive the fasteners.

11. A chair tilt mechanism according to claim 9 wherein the support arms are bent outwardly to meet the rails.

12. A chair tilt mechanism according to claim 1 wherein the load bracket is a metal stamping.

13. A chair tilt mechanism according to claim 12 wherein the housing is a metal stamping.

14. A chair tilt mechanism according to claim 13 and further comprising a stamped metal bolt bar mounted to the housing and a bolt mounted to the bolt bar, the one end of the spring being mounted to the bolt.

15. A chair tilt mechanism according to claim 1 and further comprising:

a lever pivotably mounted to the housing for controlling a height adjustment gas cylinder mounted to the housing;

a gas cylinder pawl nonrotatably mounted to the lever for actuating a gas cylinder upon rotational movement of the lever with respect to the housing; and a tilt lock mechanism mounted to the lever for locking of the load bracket in a locked position with respect to the housing, the rails being locked in the upright position relative to the housing in the locked position.

16. A chair tilt mechanism according to claim 15 wherein the tilt lock mechanism comprises a tilt lock pawl which is mounted to the lever for limited rotation with respect thereto so that the lever is rotatable through a small angle to depress a gas cylinder regardless of whether the tilt lock mechanism is in the locked or unlocked position.

17. A chair tilt mechanism according to claim 16 wherein the tilt lock pawl has a slot which receives a pawl fastener mounted to the lever, the coordination of the slot and the pawl fastener allowing limited movement of the lever with respect to the locking pawl.

18. A chair tilt mechanism according to claim 15 wherein the lever is laterally movable with respect to the load bracket in the housing to shift the locking mechanism between the locked and unlocked positions.

19. A chair tilt mechanism according to claim 18 and further comprising a spring disposed between the lever and the housing to bias the lever into one of the locked and unlocked positions.

20. A chair tilt mechanism comprising a housing adapted to be attached to a chair spindle, a pair of rails adapted to be attached to a chair seat, a pivot pin pivotably mounting the rails to the housing for pivotable rotation of the rails with respect to the housing between an upright position and a reclined position, a load bracket rigidly mounted to the rails, a spring connected at one end to the load bracket and at the other end to the housing to bias the rails toward the upright position;

a lever pivotably mounted to the housing for controlling a height adjustment gas cylinder mounted to the spindle;

a gas cylinder pawl nonrotatably mounted to the lever for actuating the height adjustment gas cylinder upon rotational movement of the lever with respect to the housing; and a tilt lock mechanism mounted to the lever for selective locking of the rails in the upright position upon relative axial movement of the lever with respect to the load bracket between a locked and unlocked position; the improvement which comprises:

a tilt lock mechanism comprises a tilt lock pawl which is mounted to the lever for limited rotation with respect thereto so that the lever is rotatable through a small angle to depress a gas cylinder regardless of whether the lever is in the locked or unlocked position.

21. A chair tilt mechanism according to claim 20 wherein the tilt lock pawl has a slot which receives a fastener mounted to the lever, the coordination of the slot and the fastener allowing limited movement of the lever with respect to the tilt lock pawl.

22. A chair tilt mechanism according to claim 20 wherein the pivot pin is mounted at a forward position of the housing so that a chair mounted to the rails tends to tilt about the knee of a user.

23. A chair tilt mechanism according to claim 20 wherein the lever is laterally movable with respect to the load bracket in the housing to shift the locking mechanism between the locked and unlocked positions.

24. A chair tilt mechanism according to claim 23 and further comprising a spring disposed between the lever and the housing to bias the lever into one of the locked and unlocked positions.

25. A chair tilt mechanism comprising a housing adapted to be attached to a chair spindle, a pair of rails adapted to be attached to a chair seat, a pivot pin pivotably mounting the rails to the housing for pivotal rotation of the rails with respect to the housing between an upright position and a reclining position and a spring connected to the rails at one end and to the housing at the other end to bias the rails toward the upright position, the improvement comprising a baffle mounted to a rear portion of the rails to shield the housing during tilting movement of the rails with respect to the housing.

26. A chair tilt mechanism comprising a housing having a spindle opening adapted to attach the housing to a vertically disposed chair spindle, a pair of rails spaced apart and adapted to be attached to a chair seat, a pivot pin pivotably mounting the rails to the housing forwardly of the spindle opening for pivotable rotation of the rails with respect to the housing between an upright position and a reclined position, a load bracket connected to the rails and having a central plate between the rails, the load bracket having a pair of side walls depending from the central plate and a pair of aligned apertures in the side walls, said pivot pin extending through the aligned apertures, and a compression spring connected at one end to the housing and at another end to the central plate of the load bracket to bias the rails toward the upright position, the spring being positioned between the spindle opening and the pivot pin, and whereby the spring is compressed as the rails pivot from the upright position to the reclined position, the improvement comprising:

the load bracket further comprises at least one support arm extending forwardly of the side walls and forwardly of the aligned apertures in the side walls;

the spring is positioned closely adjacent the spindle opening and the pivot pin is mounted closely adjacent the spring in a mid-pivot position; and a fastener extending through the at least one support arm forwardly of the pivot pin to fixedly join the load bracket to the rails, whereby the load bracket is rigidly joined to the rails and the rails pivot about a mid-tilt axis between the front end of the rails and the spindle opening.

27. A chair tilt mechanism according to claim 26 wherein there are two support arms, one extending forwardly from each of the side walls, and a fastener extends through each of the support arms to rigidly join each of the support arms to a respective rail.

28. A chair tilt mechanism according to claim 26 wherein the compression spring is a coil spring which has an axis generally transverse to a horizontal plane when the chair tilt mechanism is mounted to a vertically disposed spindle.

29. A chair tilt mechanism according to claim 28 wherein the coil spring is a cylindrical coil spring.

* * * * *